US006139377A

United States Patent [19]

Chen

[11] Patent Number: 6,139,377

[45] Date of Patent: Oct. 31, 2000

[54] MATERIAL PLATE FOR FORMING CONNECTOR TERMINALS WITH A LARGER DISTANCE THEREBETWEEN

[76] Inventor: Yu-Tang Chen, No.33, Tong Yuan Rd. Chungli Ind. Park, Taoyuan, Taiwan

[21] Appl. No.: 09/251,712

[22] Filed: Feb. 17, 1999

[51] Int. Cl.[7] ..... H01R 9/24; H01R 13/02

[52] U.S. Cl. ..... 439/885

[58] Field of Search ..... 439/885, 637, 439/884, 590, 636

[56] References Cited

U.S. PATENT DOCUMENTS 4,795,374 1/1989 Rishworth et al. ..... 439/634

*Primary Examiner*—Neil Abrams
*Assistant Examiner*—Hae Moon Hyeon
*Attorney, Agent, or Firm*—Pro-Techtor International Services

[57] ABSTRACT

A material plate for forming an electric connector includes a main plate, a number of legs extended from the main plate, a number of spaced terminal main bodies spaced from the main plate, a number of spaced horizontal pins, and a number of elevated pins. The terminal main bodies are integrally formed with the horizontal pins and the elevated pins in an alternate manner. Each elevated pin includes a root end that is integrally formed with an end of an associated terminal main body. Each leg extends between an associated elevated pin and an associated horizontal pin. A distal end of each leg is located adjacent to the root end of the associated elevated pin. The distal end of each leg includes a connecting piece that is connected to the associated main body with which the associated elevated pin is integrally formed. The connecting piece is also connected to the associated horizontal pin. Each connecting piece includes a V-shaped cut located adjacent to the associated horizontal pin. Each connecting piece further includes a V-shaped transverse cut located adjacent to the root section of the associated elevated pin. The main plate and the legs can be removed by means of breaking along the V-shaped cuts and the V-shaped transverse cuts.

1 Claim, 9 Drawing Sheets

MATERIAL PLATE FOR FORMING CONNECTOR TERMINALS WITH A LARGER DISTANCE THEREBETWEEN

BACKGROUND OF THE INVENTION

1. Field of the Invention

The present invention relates to a material plate for forming electric connector terminals with a larger distance therebetween, and more particularly to connector terminals that can be formed and spaced by a larger distance to avoid generation of interference signals as a result of narrow distance between two adjacent connector terminals.

2. Description of the Related Art

FIG. 1 of the drawings illustrates a typical connector for connecting an extension circuit board with a main circuit board of a computer. The connector generally includes a number of terminals 20 each having a slant sections 21 inside an insulating casing 10 to provide resiliency for an engaging slot 11 that receives a connecting edge of the extension circuit board (not shown). Each terminal 20 includes a pin 22 partially exposed outside the casing 10 for connecting with the main circuit board (not shown) of the computer (not shown).

FIGS. 2 and 3 illustrate a material plate 30 for forming the connector terminals 20. The material plate 30 includes a plurality of legs 31 each having a distal end integrally formed with an end of a main body of a terminal 20 from which a pin 22 extends. The terminals 20 are equidistantly arranged and are extended through the casing 10, as shown in FIG. 4. As can be seen from FIG. 5, the central axes of two adjacent terminals 20 are spaced by a distance "C". The portion of each terminal 20 below line A—A in FIG. 5 is located inside the casing 10. A V-shaped cut 32 is defined in each leg 31 and located on the line A—A to allow the material plate 30 to be broken along the cut 32. Nevertheless, two adjacent connector terminals 20 thus formed have a small distance therebetween (see the distance between points B1 and B2) such that interference signals are generated when used in high speed signal transmission.

The present invention is intended to provide an improved connector terminals that have large distance therebetween to mitigate and/or obviate the above problems.

SUMMARY OF THE INVENTION

It is a primary object of the present invention to provide a material plate for forming electric connector terminals with a larger distance therebetween.

A material plate for forming an electric connector in accordance with the present invention includes a main plate, a plurality of legs extended from the main plate, a plurality of spaced terminal main bodies spaced from the main plate, a plurality of spaced horizontal pins, and a plurality of elevated pins.

The terminal main bodies are integrally formed with the horizontal pins and the elevated pins in an alternate manner. Each elevated pin includes a root end that is integrally formed with an end of an associated terminal main body.

Each leg extends between an associated elevated pin and an associated horizontal pin. A distal end of each leg is located adjacent to the root end of the associated elevated pin. The distal end of each leg includes a connecting piece that is connected to the associated main body with which the associated elevated pin is integrally formed. The connecting piece is also connected to the associated horizontal pin.

Each connecting piece includes a V-shaped cut located adjacent to the associated horizontal pin. Each connecting piece further includes a V-shaped transverse cut located adjacent to the root section of the associated elevated pin. Thus, the main plate and the legs can be removed by means of breaking along the V-shaped cuts and the V-shaped transverse cuts.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
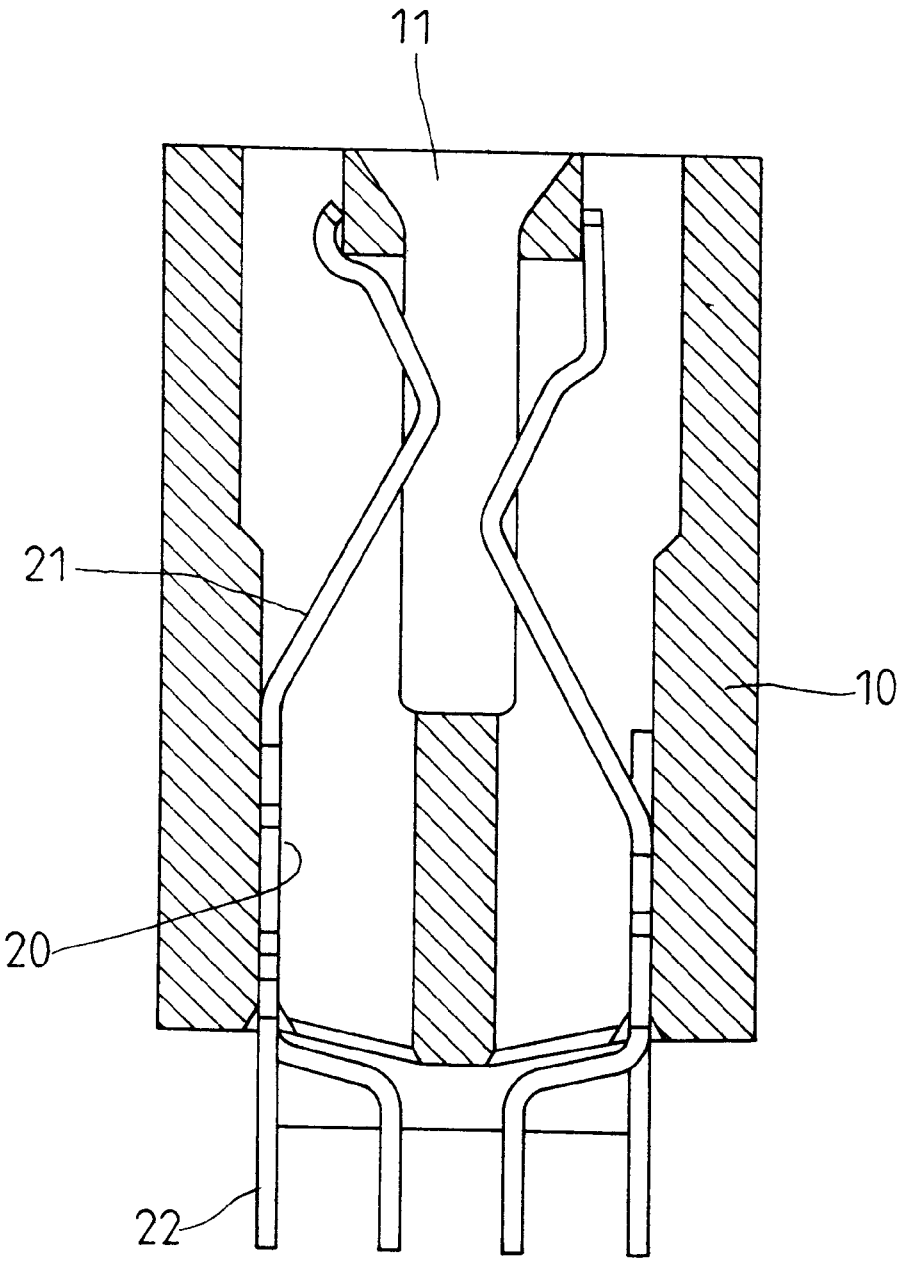
FIG. 1 PRIOR ART
FIG. 1 is a sectional view of a conventional electric connector.
Figure 2:
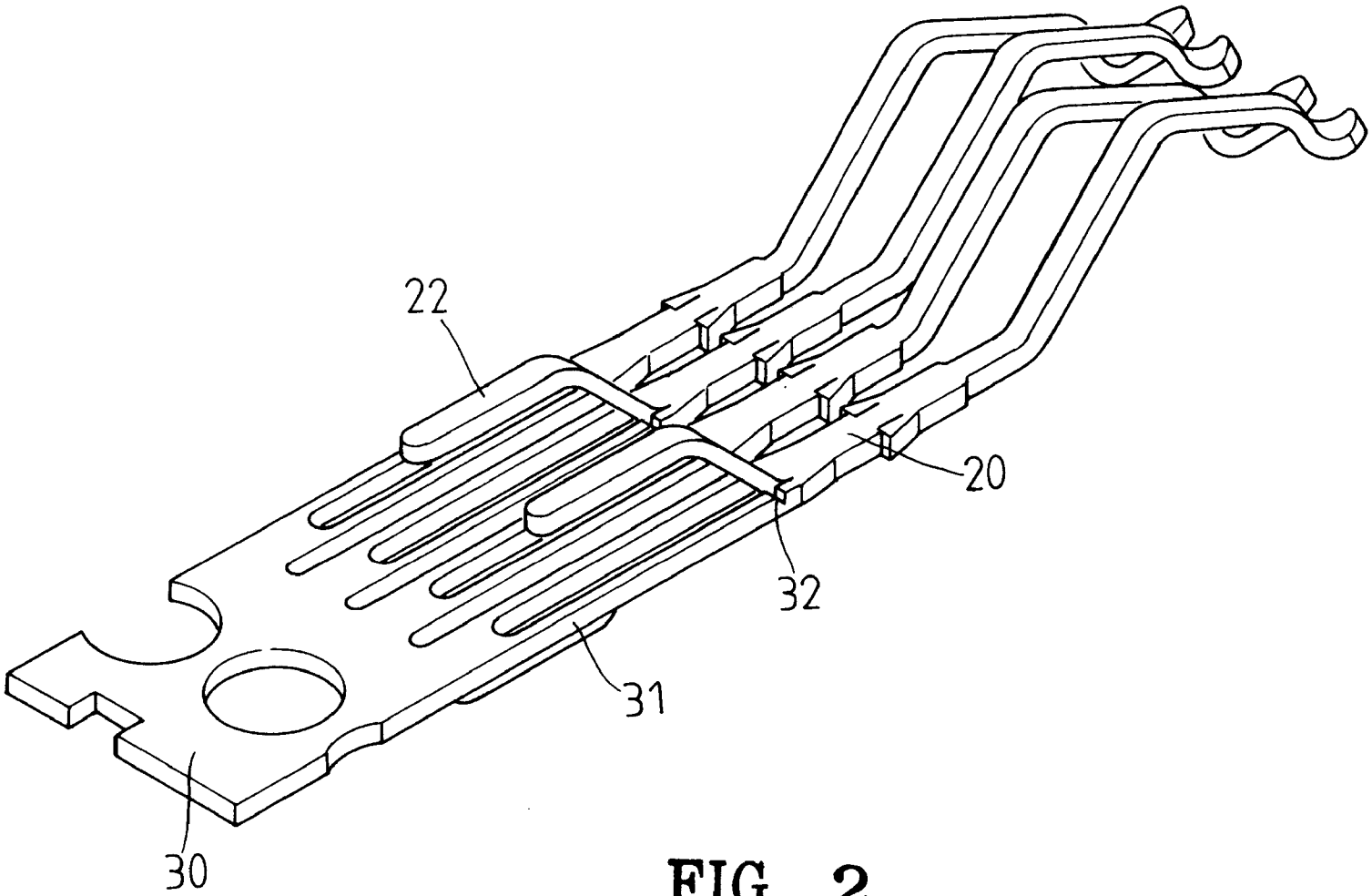
FIG. 2 PRIOR ART
FIG. 2 is a perspective view of a material plate for forming the conventional electric connector in FIG. 1.
Figure 3:
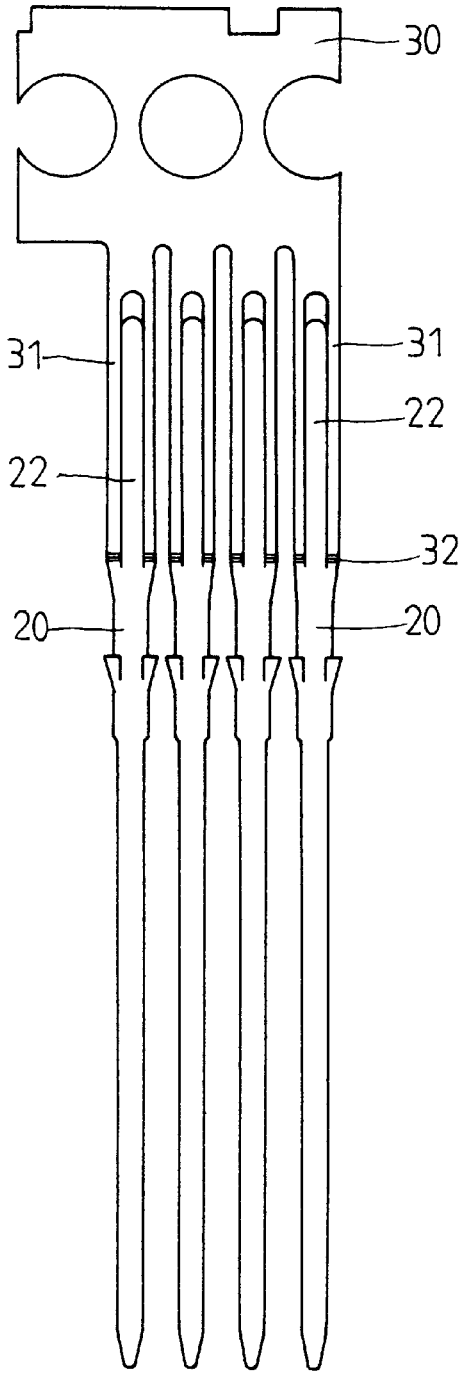
FIG. 3 PRIOR ART
FIG. 3 is a top view of the material plate.
Figure 4:
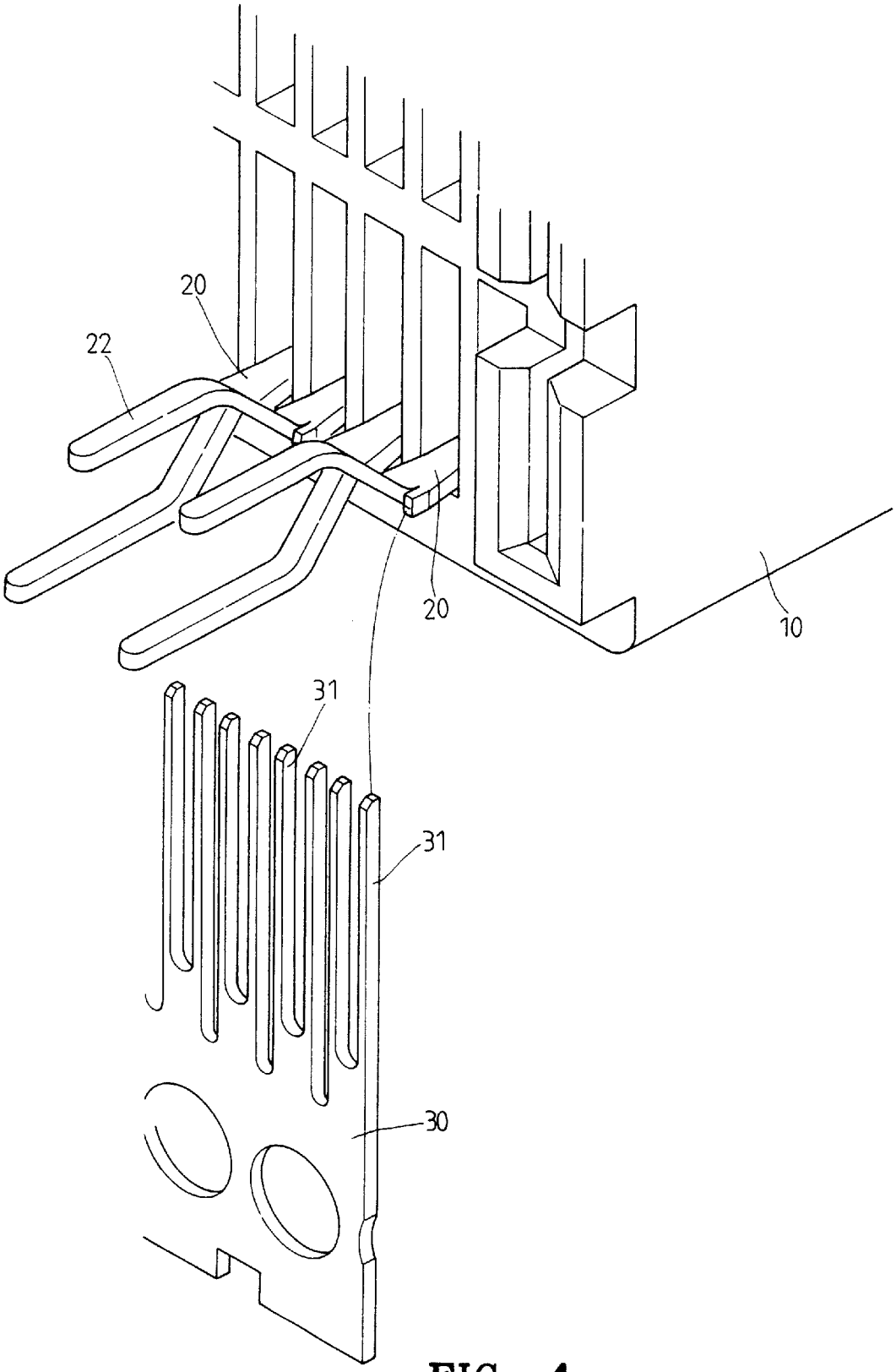
FIG. 4 PRIOR ART
FIG. 4 is a perspective view illustrating formation of the conventional electric connector.
Figure 5:
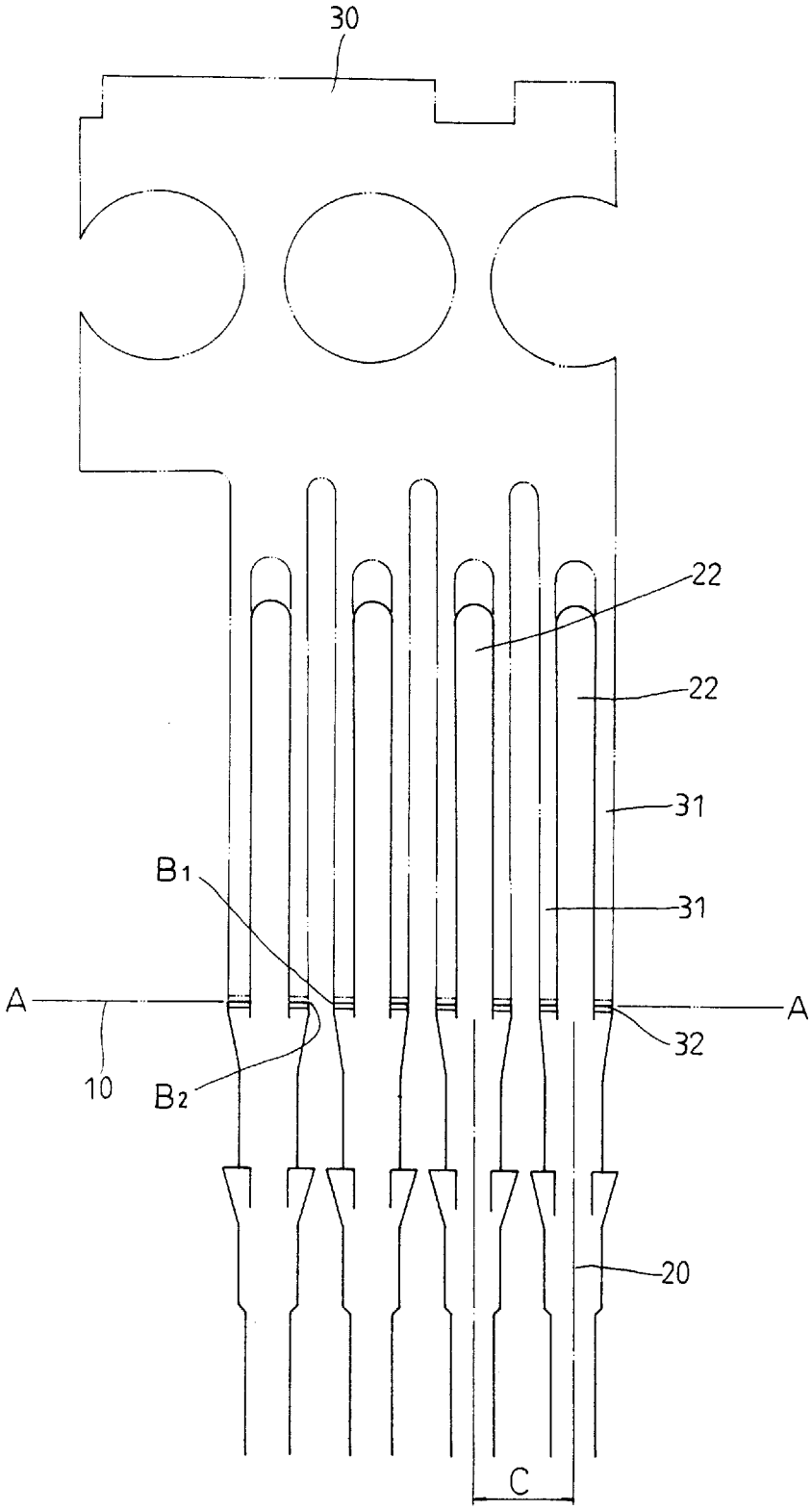
FIG. 5 PRIOR ART
FIG. 5 is a top view illustrating the material plate before the legs are broken.
Figure 6:
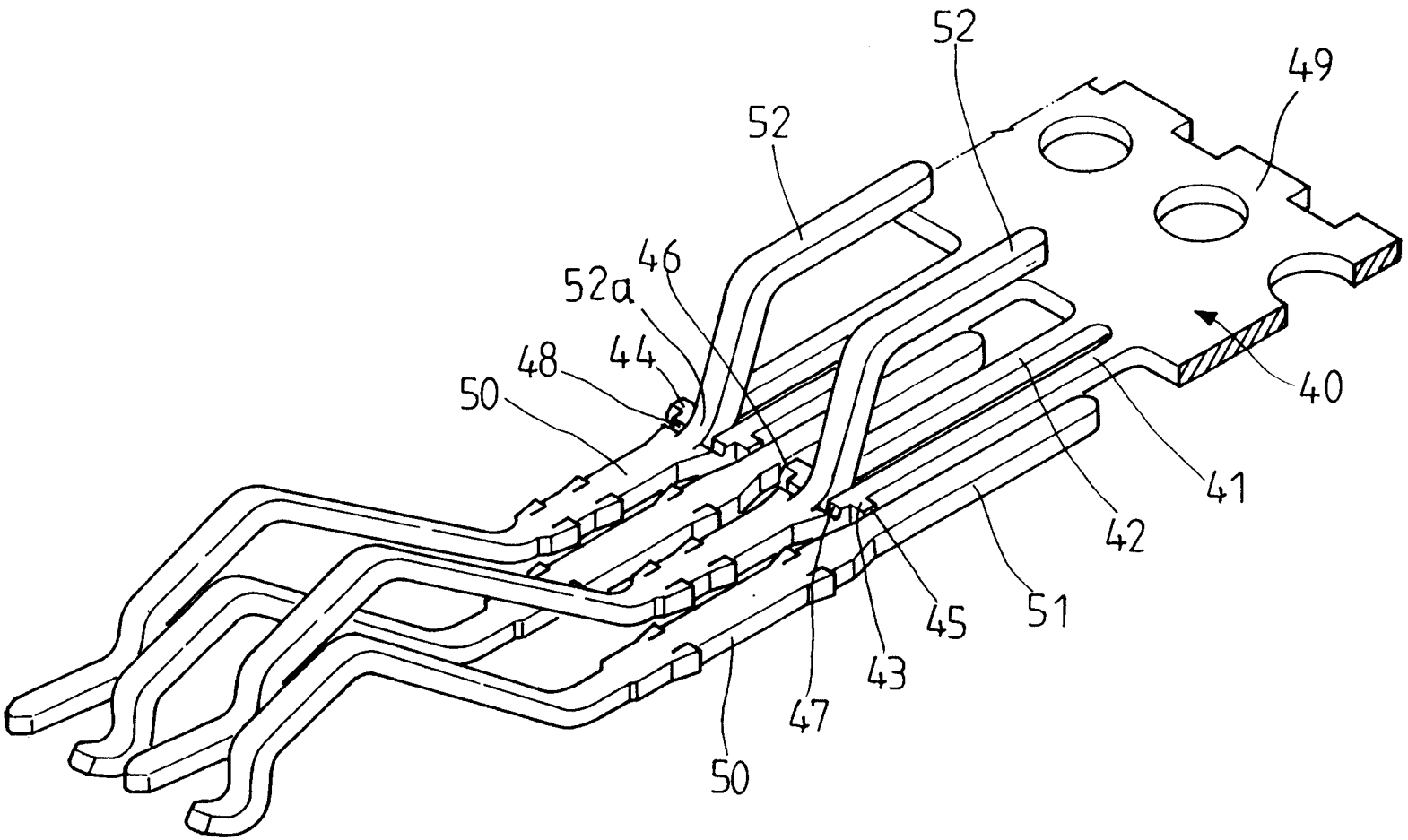
FIG. 6 is a perspective view of a material plate for forming an electric connector in accordance with the present invention.
Figure 7:
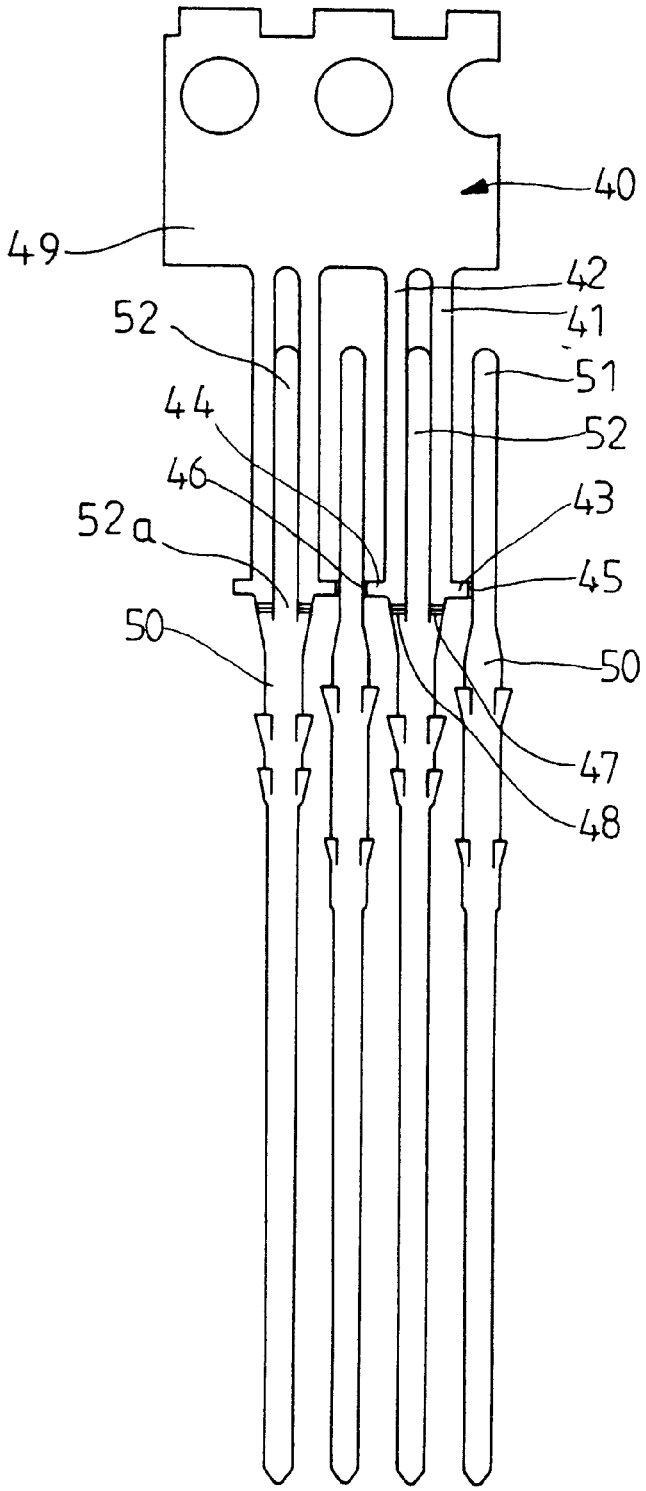
FIG. 7 is a top view of the material plate in FIG. 6.

Referring to FIGS. 6 to 9 and initially to FIGS. 6 and 7, a material plate 40 for forming an electric connector in accordance with the present invention generally includes a main plate 49 with a plurality of legs 41 and 42 extended therefrom, a plurality of equidistantly disposed terminal main bodies 50 spaced from the main plate 49, a plurality of spaced horizontal pins 51, and a plurality of elevated pins 52.

Still referring to FIGS. 6 and 7, the terminal main bodies 50 are integrally formed with the horizontal pins 51 and the elevated pins 52 in an alternate manner by means of punching. More specifically, as can be seen from FIG. 6, each of the first terminal main body 50 and the third terminal main body 50 is integrally formed with an elevated pin 52, while each of the second terminal main body 50 and the fourth terminal main body 50 is integrally formed with a horizontal pin 51. Each elevated pin 52 includes a root end 52*a* that is integrally formed with an end of an associated terminal main body 50. Located on two sides of the root end 52*a* of each elevated pin 52 are distal ends of two legs 41, 42, respectively. Each leg 41 extends between an associated elevated pin 52 and an associated horizontal pin 51. The distal end of the leg 41 includes a connecting piece 43 that is connected to the end of the associated terminal main body 50. The connecting piece 43 is also connected to an associated horizontal pin 51 that locates adjacent to the associated elevated pin 52. Similarly, the distal end of the leg 42 includes a connecting piece 44 that is connected to the first end of an associated terminal main body 50. The connecting piece 44 is also connected to an associated horizontal pin 51 that locates adjacent to the associated elevated pin 52.

Each connecting piece 43, 44 includes a V-shaped cut 45, 46 that is formed by punching and located adjacent to the associated horizontal pin 51. Each connecting piece 45, 46 further includes a V-shaped transverse cut 47, 48 that is also formed by punching and located adjacent to the root end 52*a* of an associated elevated pin 52. By such arrangement, the distance between a side W2 of the horizontal pin 51 of a terminal and a side W1 of the end of the main body 50 of an adjacent terminal is larger than that of conventional electric connector.

Figure 8:
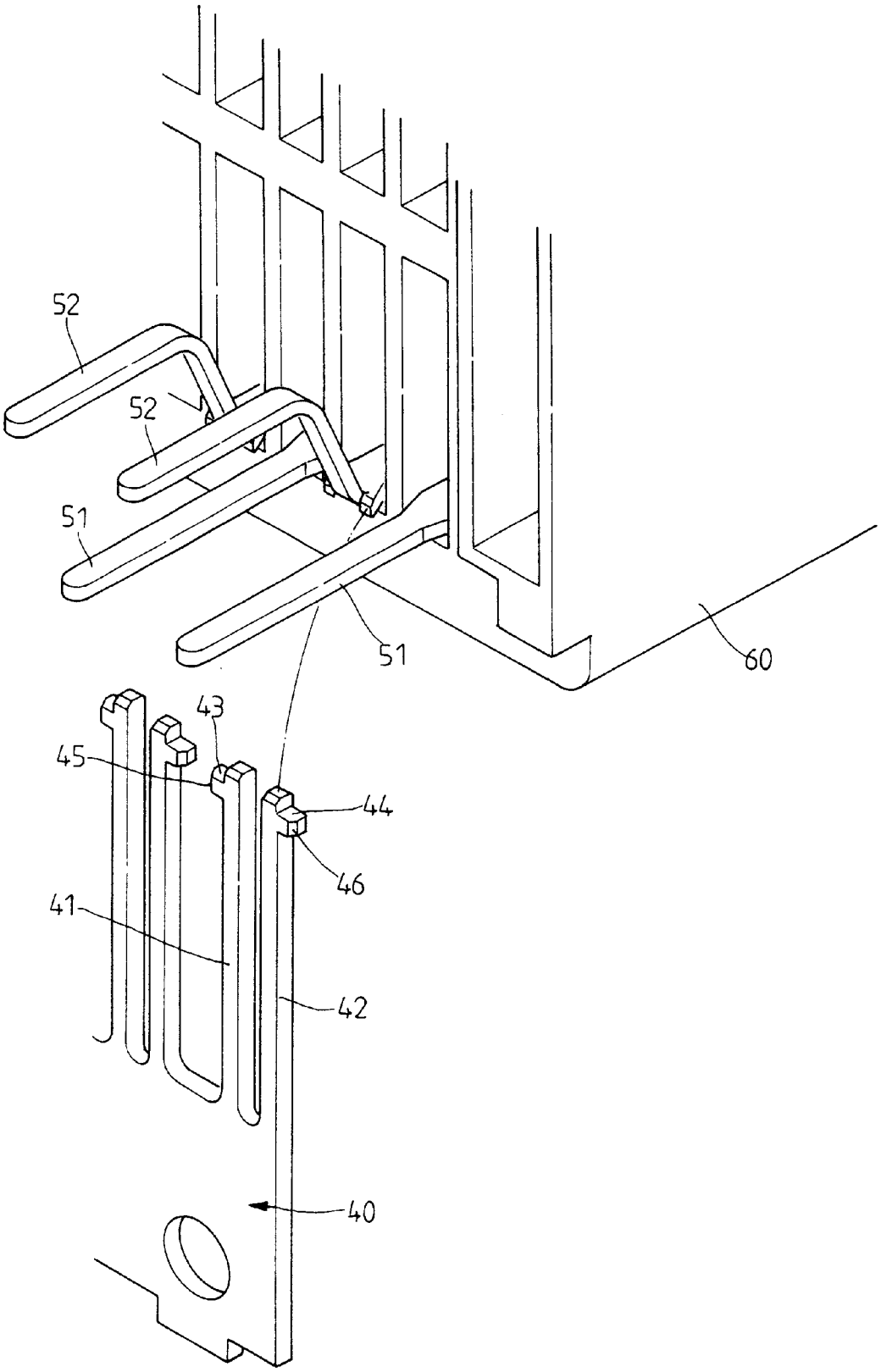
FIG. 8 is a perspective view illustrating formation of the electric connector in accordance with the present invention.
Figure 9:
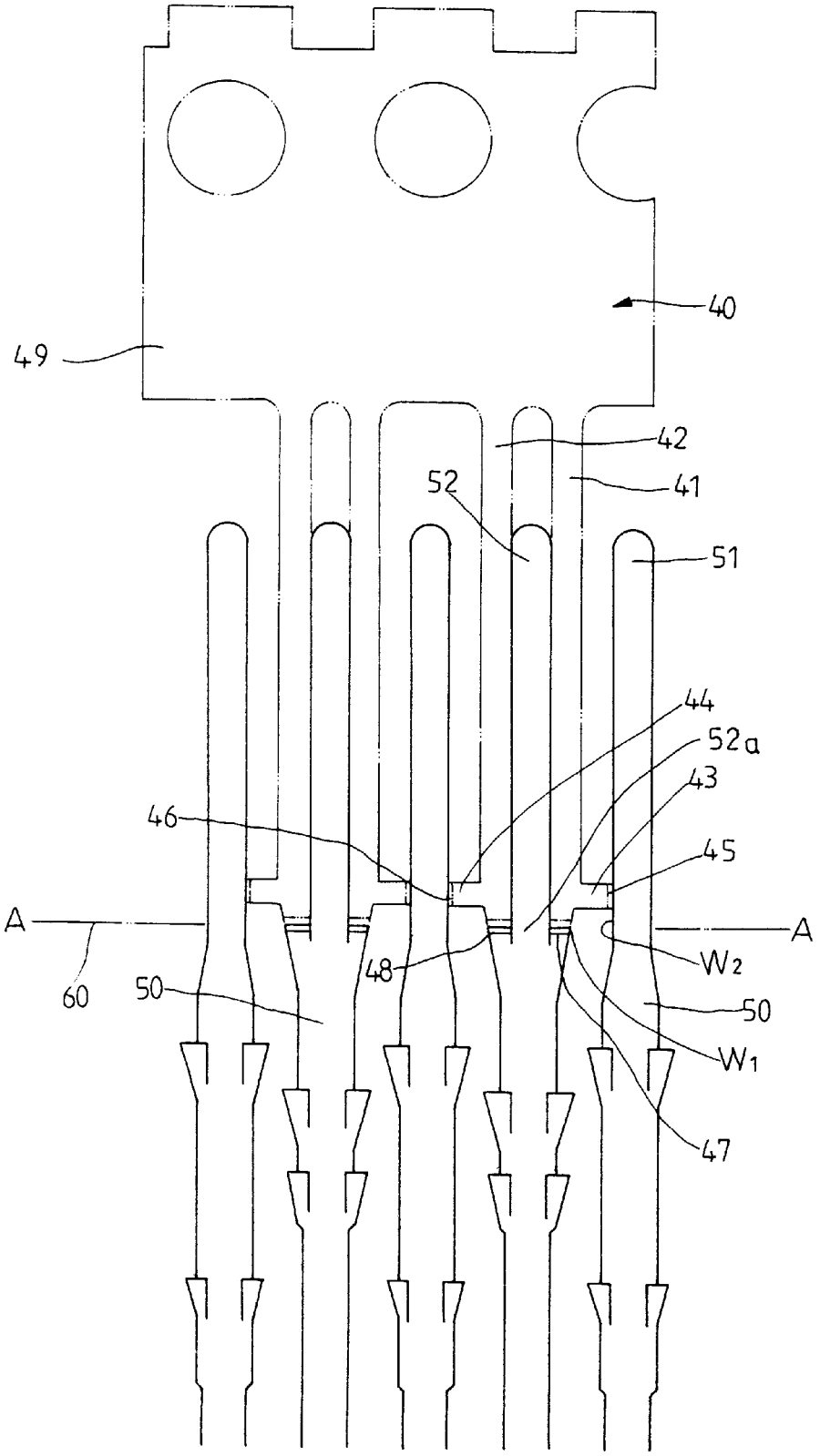
FIG. 9 is a top view illustrating the material plate before the legs are broken.

Referring to FIG. 8, after the terminal main bodies 50 are inserted into a casing 60 of the connector and reaches a depth indicated by line A—A (FIG. 9), the main plate 49 as well as the legs 41 and 42 by means of breaking along the cuts 45, 46, 47, and 48. Thus, a portion of the material plate 40 indicated by the phantom lines in FIG. 9 is removed, while the remaining portion of the material plate 40 below line A—A is retained inside the casing 60 of the connector with the horizontal pins 51 and elevated pins 52 exposed outside the casing 60 for connecting with a main circuit board of, e.g., a computer. It is appreciated that interference signals are prevented, as the distance between a side W2 of the horizontal pin 51 of a terminal and a side W1 of the end of the main body 50 of an adjacent terminal is larger.

Although the invention has been explained in relation to its preferred embodiment, it is to be understood that many other possible modifications and variations can be made without departing from the spirit and scope of the invention as hereinafter claimed.

What is claimed is:

1. A material plate for forming an electric connector, comprising:

a main plate, a plurality of connecting legs extended from the main plate, a plurality of spaced terminal main bodies connected to said main plate by said connecting legs, a plurality of spaced horizontal pins and a plurality of elevated pins, said terminal main bodies being integrally formed with said horizontal pins and said elevated pins in an alternating manner, each said elevated pin including a root end that is integrally formed with an end of an associated said terminal main body, each of said connecting legs extending between an associated one of said elevated pins and an associated said horizontal pins, a distal end of each said connecting leg being located adjacent to said root end of said associated said elevated pin, said distal end of each said connecting leg including a connecting piece that is connected to said associated main body with which said associated elevated pin is integrally formed, said connecting piece being also connected to said associated horizontal pin, and each said connecting piece including a V-shaped cut located adjacent to said associated horizontal pin, each said connecting piece further including a V-shaped transverse cut located adjacent to said root end of said associated elevated pin, thereby allowing said main plate and said connecting legs to be removed by means of breaking along said V-shaped cuts and said V-shaped transverse cuts.

* * * * *